US006367581B1

(12) United States Patent
Marler et al.

(10) Patent No.: US 6,367,581 B1
(45) Date of Patent: Apr. 9, 2002

(54) SOUND ABSORBING LIGHT FIXTURE

(75) Inventors: Mark E. Marler, Glastonbury; Charles C. Coffin, Vernon; Brad Guilani, Woodstock Valley; Heng-Yi Lai, Vernon; Patricia A. Derwinski, Farmington, all of CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/578,377

(22) Filed: May 25, 2000

(51) Int. Cl.[7] ..... E04B 1/82
(52) U.S. Cl. ..... 181/295; 454/293; 362/355
(58) Field of Search ..... 181/284, 286, 181/287, 289, 295, 30; 362/147, 96, 148, 149, 150, 223, 311, 355; 454/293, 294, 296; 187/401, 414

(56) References Cited

U.S. PATENT DOCUMENTS 3,460,299 A * 8/1969 Wilson ..... 181/295
3,743,826 A * 7/1973 Halfaker ..... 362/149
4,747,028 A * 5/1988 Piotrovsky ..... 362/355
4,849,862 A * 7/1989 Diskin et al. ..... 362/96
5,454,756 A * 10/1995 Ludwig ..... 454/296
5,564,529 A * 10/1996 Ericson et al. ..... 187/401

* cited by examiner

*Primary Examiner*—Khanh Dang

(57) ABSTRACT

A sound absorbing light fixture (42) installed in a surface system, such as an elevator ceiling system (40), of an enclosed interior, such as the interior (32) of an elevator cab (32) is presented. The light fixture (42) comprises a frame (46) disposed in fixed relationship to the surface system, the frame (46) having an interior rear surface and interior side surfaces extending outwardly from the rear surface to define a cavity (50). A light source (48) is supported by the frame (46) within the cavity (50). Additionally, a light diffuser (44) is disposed in fixed relationship to a front portion of the frame (46) between the light source (48) and the enclosed interior. The installed light fixture (42) enhances a sound absorption coefficient, e.g., above 0.6, of the surface system for a predetermined frequency range of sound energy, e.g., 300–600 Hz.

23 Claims, 4 Drawing Sheets

SOUND ABSORBING LIGHT FIXTURE

FIELD OF THE INVENTION

The present invention relates generally to light fixtures. More specifically, the present invention relates to a sound absorbing light fixture for an elevator cab.

BACKGROUND OF THE INVENTION

Conventional interiors of elevator cabs are made of rigid non-porous materials which absorb little or none of the sound energy which penetrates the cab. In these conventional interiors, the sound absorption coefficient, i.e., the ratio of absorbed sound energy to incident sound energy, is very low, e.g., typically less than 10%. In some prior art elevator cabs, porous materials are disposed on the interior walls to enhance the overall absorption coefficient and construct a sound energy absorbing interior which will reduce the interior noise level and improve the passengers' ride quality.

However, optimizing the absorption coefficient of the elevator cab ceiling system is made more difficult by the lighting fixtures, which can cover over ninety percent (90%) of the interior ceiling surface. Many elevator ceiling systems are made so that solid translucent plastic sheet diffusers are placed into a light fixture frame which is suspended between the light bulb, florescent or incandescent, and the interior cab space occupied by the passengers. These solid plastic diffusers serve to shield the bright light from the passengers and spread the light more evenly throughout the interior. These covers do not have desirable acoustic properties though. The rigid non-porous diffuser reflects, rather than absorbs, most of the acoustic energy which contacts its surface.

The frames of the light fixtures are also generally constructed of rigid materials having low absorption coefficients. Moreover the space between the plastic diffusers and the frame defines an air filled cavity that will result in the formation of a standing wave pattern inside the cavity and may cause resonances at certain frequencies if not properly dampened.

There is a need therefore, for an improved light fixture for an interior such as an elevator cab.

SUMMARY OF THE INVENTION

The present invention offers advantages and alternative over the prior art by providing a sound absorbing light fixture that enhances the acoustical performance of an elevator ceiling system. The light fixture reduces interior noise and improves ride quality of an elevator system. Moreover, the light fixture can be used as a kit to retrofit existing elevator ceiling system.

These and other advantages are accomplished in an exemplary embodiment of the invention by providing a sound absorbing light fixture installed in a surface system, such as an elevator ceiling system, of an enclosed interior, such as an elevator cab. The light fixture comprises a frame disposed in fixed relationship to the surface system, the frame having an interior rear surface and interior side surfaces extending outwardly from the rear surface to define a cavity. A light source is supported by the frame within the cavity. Additionally, a light diffuser is disposed in fixed relationship to a front portion of the frame between the light source and the enclosed interior. The installed light fixture enhances a sound absorption coefficient of the surface system over a predetermined frequency range of sound energy, e.g., 100–2000 Hz.

In an exemplary embodiment of the invention, the diffuser further comprises a material having an impedance substantially matched to a redetermined percentage range of air impedance for a predetermined frequency range.

In an alternative embodiment, the cavity is sized to attenuate sound energy within a predetermined frequency range.

Additionally, in another alternative embodiment, the interior rear surface of the frame is lined with a sound absorbing material, such as acoustic foam.

DETAILED DESCRIPTION OF THE PREFERRED EMBODIMENTS

The present invention is directed toward optimizing the sound absorption coefficient of a ceiling system of an elevator cab interior utilizing a sound absorbing light fixture.

Figure 1:
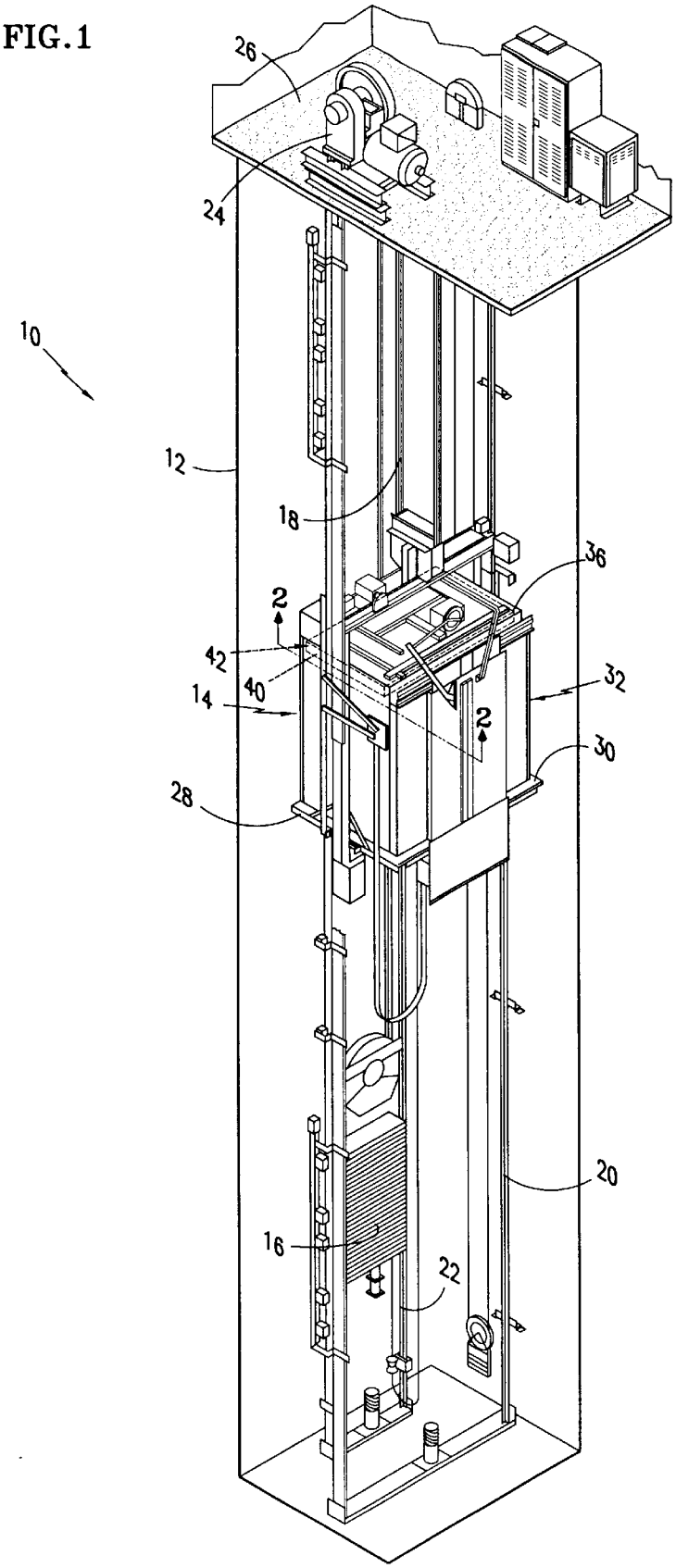
FIG. 1 is a schematic perspective view of an elevator system in accordance with the present invention.

Referring to FIG. 1, an exemplary embodiment of an elevator system in accordance with the present invention is shown generally at 10. The elevator system comprises an elevator hoistway 12, having an elevator car 14 positioned therein for vertical movement. The elevator car 14 is suspended and coupled to a counterweight 16 for relative movement therewith through a set of elevator ropes 18. Car guide rails 20 and counterweight guide rails 22 provide T-shaped tracks which guide the elevator car 14 and counterweight 16 respectively throughout the hoistway 12. An elevator hoisting machine 24 is located in elevator machine room 26 or elevator hoistway 12 and provides the mechanical power to hoist the elevator car 14 and passengers.

The elevator car 14 includes an elevator car frame 28, an elevator platform 30, and an elevator cab or cabin 32. The elevator cab 32 typically comprises four vertical walls 34 and a roof 36 and is disposed on the elevator platform 30. The elevator platform 30 is disposed on the car frame 28, which provides external structural support for the cab 32 and platform 30 of the elevator car 14.

The platform 30, together with walls 34 and roof 36 of the elevator cab 32, define an enclosed interior 38 within which passengers ride. The top of the interior 38 consists of the elevator ceiling system 40 which includes sound absorbing light fixture 42. As will be discussed in greater detail hereinafter, the acoustical performance of the light fixture 42 enhances the sound absorption coefficient of the ceiling system to provide improved ride quality for the passengers by reducing interior noise.

Figure 2:
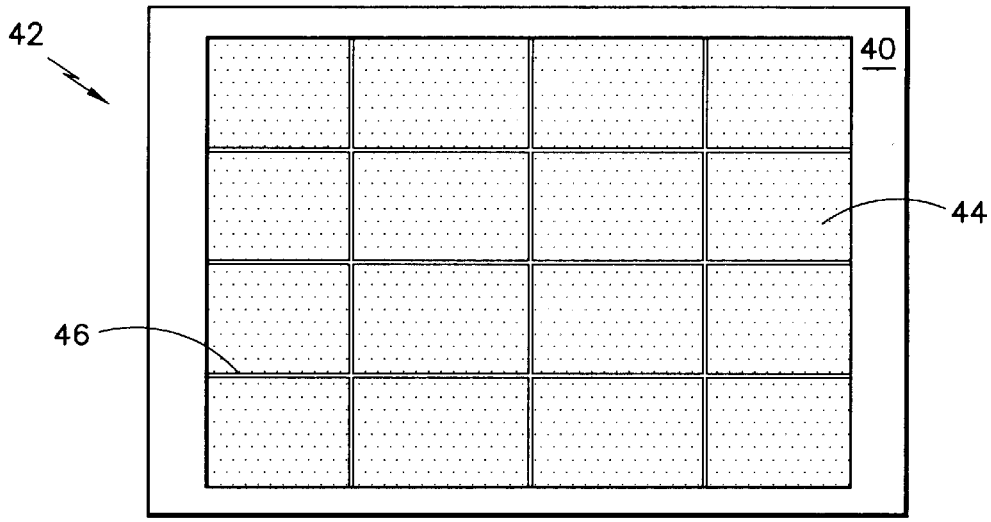
FIG. 2 is a cross-sectional view of FIG. 1 taken along the line 2—2 showing the front of the sound absorbing light fixture installed in the elevator ceiling system.
Figure 3:
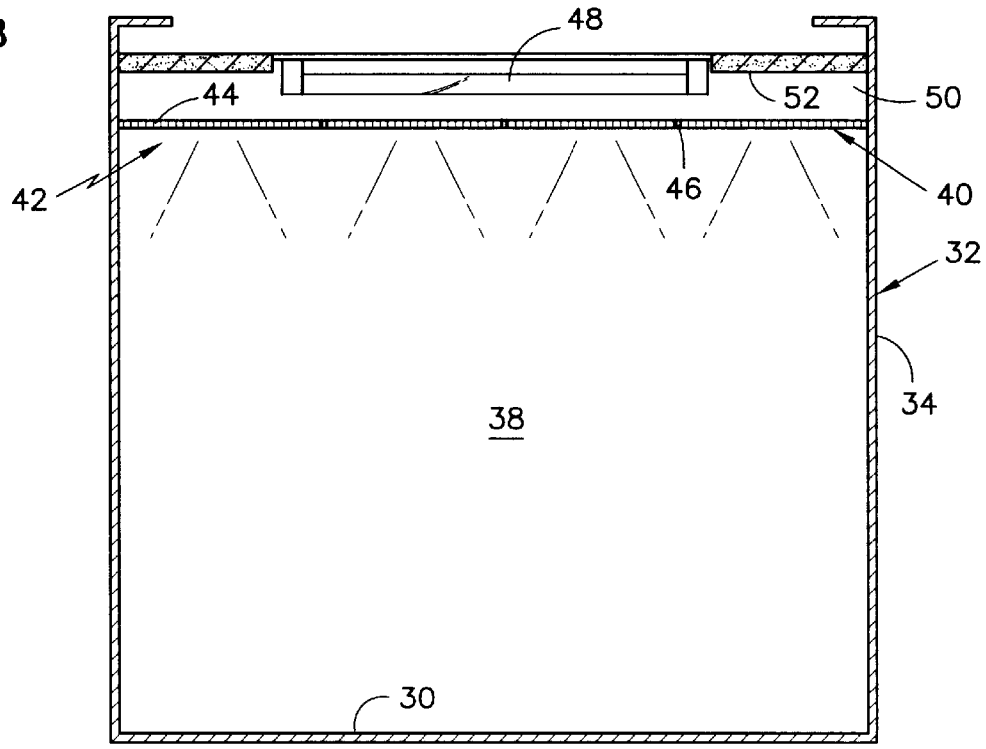
FIG. 3 is a schematic side view of the light fixture of FIG. 2.

Referring to FIGS. 2 and 3, a front and side view respectively of the sound absorbing light fixture 42 is shown. The ceiling system 40 is designed to receive the light fixture 42 therein. Ceiling system 40, together with walls 34 and platform 30, define the interior 38 of the elevator cab 32. The light fixture 42 includes porous light diffusers 44 suspended from a light fixture frame 46 which supports a light source 48, e.g., a florescent or incandescent bulb. In this embodiment the porous light diffusers 44 are composed of a micro-perforated film, however other materials with both light diffusing characteristics and carefully selected acoustic properties may also be used. The space between the porous diffusers 44 and the interior of the frame 46 defines an air filled cavity 50 which forms a standing wave sound field inside the cavity. The rear wall of the frame 46 is lined with a sound absorbing material 52. In this embodiment the sound absorbing material is a 2 inch layer of white melamine foam manufactured by Illbruck, however other sound absorbing materials and thicknesses may also be used to obtain broad band acoustic performance, e.g., acoustic foam, fiberglass or cork.

The absorption coefficient of the light fixture 42 is optimized by improving the acoustic performance of at least three (3) structures: the porous diffuser 44, the light fixture cavity 50, and the sound absorbing material 52.

The acoustic performance of the porous light diffuser 44 is optimized by matching its acoustic impedance as closely as possible to that of the air within a predetermined frequency range. If a sound wave traveling through air hits a different medium with a substantially different acoustic impedance, such as rigid plastic, a large portion of the acoustic energy will be reflected back. However the more closely the impedance of the different medium is matched to that of the air, the less energy is reflected and the greater its absorption coefficient will be. If the match is perfect for a given frequency, there will be no reflected energy and all sound energy at that frequency will be absorbed. Since acoustic impedance and absorption coefficient of a medium varies with frequency, the impedance matching is typically done over a predetermined frequency range, e.g., 300–600 Hz.

In order for impedance matching to occur the diffuser must have the correct acoustic properties such as, but not limited to:

(i) Porosity: the ratio of the void volume to the material volume.

(ii) Flow resistivity: the ratio of the pressure difference across the sample to the flow velocity running through the sample, and normalized by the sample thickness. It has a unit of Rayls/m and is the most important parameter determining the acoustical performance of a material.

(iii) Tortuosity: a ratio of the length of the pore flow path vs. the thickness of the diffuser sheet, typically having a value from 1 to 3. For example, when the tortuosity is equal to 1.3 its pore path is 30% greater than a perfectly cylindrical pore parallel to the wave propagating direction through the sheet.

Figure 4:
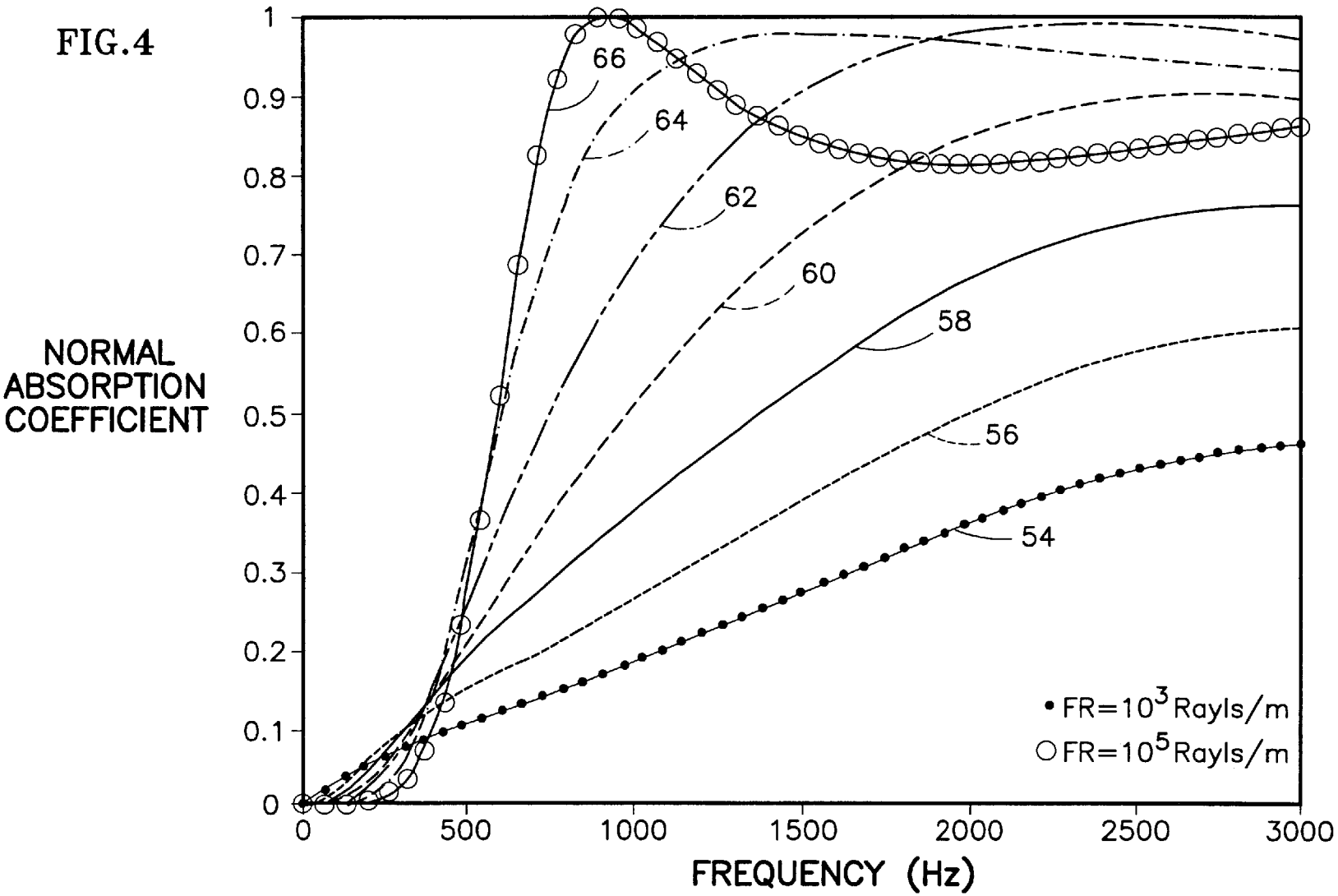
FIG. 4 is a graph of flow resistivity vs. sound absorption of various diffuser materials in accordance with the present invention.

Referring to FIG. 4, a series of curves of flow resistivity vs. normal absorption coefficient is shown. The curves demonstrate the effects that flow resistivity of a porous material has on its sound absorbing performance. Each curve represents a unique constant value of flow resistivity as follows:

| Curve item number | flow resistivity value (rayls/m) |
|---|---|
| 54 | 1000 |
| 56 | 2150 |
| 58 | 4640 |
| 60 | 10,000 |
| 62 | 21,500 |
| 64 | 46,400 |
| 66 | 100,000 |

At 1000 Hz the absorption coefficient associated with curve 66 peaks very close to 1. For this example, the impedance of the selected material at 1000 Hz, having a flow resistivity of 100,000 rayls/m, will closely match the impedance of air and very little sound energy will be reflected back. However, at 2000 Hz the absorption coefficient of curve 66 drops to about 0.8, below that of curves 60,62 and 64. This demonstrates the frequency dependence of flow resistivity and the importance of selecting a target flow resistivity for a predetermined frequency range.

The target flow resistivity of a porous material depends on the whole ceiling system 40 design, e.g., ceiling depth, number of layers, type of materials and the specified frequency spectrum. The range of flow resistivity of most typical porous material can vary within 100 to $10^7$ Rayls/m. Therefore, the flow resistivity for the diffuser 44 is a factor that must be considered in order to optimize the absorption coefficient of the ceiling system 40 design.

By way of example, the following materials were tested for use as diffuser 44 material and found to have acceptable sound absorption and light diffusing qualities:

| Manufacturer | Grade Name | Material Type | Physical Characteristics |
|---|---|---|---|
| 1) 3M | MPF | Micro-perforated film | 0.0055" pore size, 1.1% porosity |
| 2) Porex Technologies | 4909 | Polypropylene | 0.125" width thick, medium porosity, 120 micron average pore size |
| 3) Porex Technologies | 4912 | Polypropylene | 0.250 thick width, coarse porosity, 250 micron average pore size |

The optimization of the acoustical performance of the light fixture frame 46 depends on such factors as: the types of materials used, the combination or configuration of various materials, and the available surface area and volume. In this embodiment, sound absorbing material 52 is used to line the rear wall of the light fixture frame 46 to absorb the sound energy as it passes through the diffusers 44 and to enhance the overall absorption coefficient of the light fixture 42 and ceiling system 40.

The depth of the light fixture cavity 50 is designed to enhance the low frequency performance. Typically, for any given frequency, sizing the depth of the cavity to substantially equal to twenty five percent (25%) of the wavelength provides the most effective attenuation. Since sound energy will vary across the sound frequency range, the cavity is sized to attenuate a predetermined range of sound frequencies, e.g., 100 to 2000 Hz.

Figure 5:
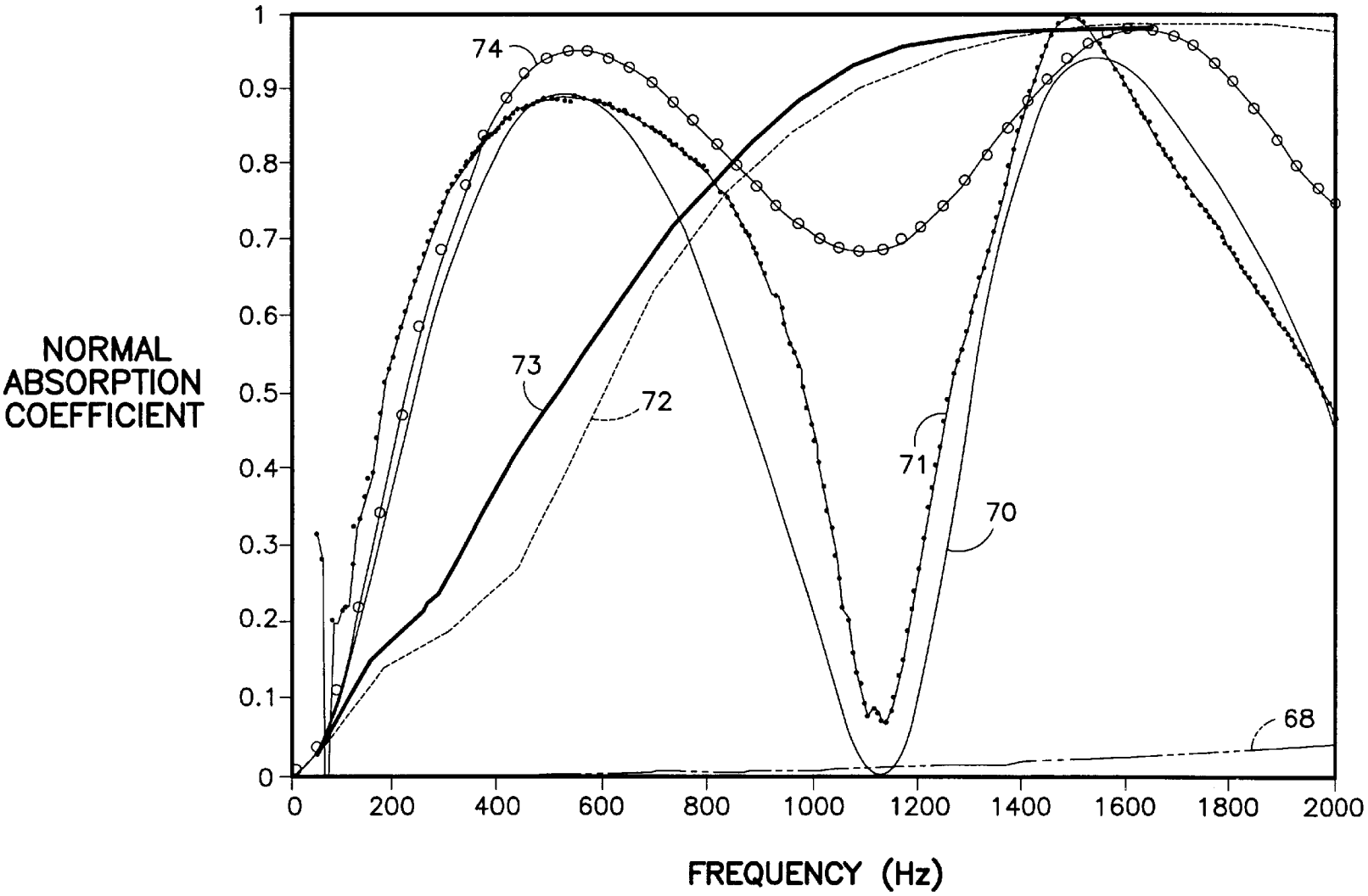
FIG. 5 is a graph of actual measurements and predictions of normal absorption coefficients for various acoustical ceiling designs in accordance with the present invention.

Referring to FIG. 5, a series of actual and predicted curves of normal absorption coefficients vs. frequency for various ceiling designs is show. The design goal is to maximize the sound absorbing capability of the ceiling system 40 over a predetermined frequency range, e.g., 300–600 Hz. Therefore, the sound absorption coefficient of the ceiling system is the target to be optimized. The absorption coefficient can be obtained from the ceiling surface impedance and it is a combined value from the impedance of each acoustical component installed within the system. The acoustical components of most importance in FIG. 5 are the porous light diffuser 44, the cavity 50 and the sound absorbing material 52. Each one represents a different acoustical layer within the light fixture 42 that effects the overall ceiling system 40 absorption coefficient.

Curve 68 is a predicted graph of a prior art light fixture having a smooth plastic diffuser plate installed in an elevator ceiling system. As can be seen, the ceiling absorption coefficient remains well below 0.1 across the entire frequency range shown.

Curve 70 is a predicted graph and curve 71 is an actual measurement graph of an installed light fixture having a diffuser composed of micro-perforated film suspended in front of a 6 inch deep cavity. This combination produces a ceiling absorption coefficient of 0.6 within the frequency ranges of approximately 300 Hz to 800 Hz and 1300 Hz to 1900 Hz. Moreover, the absorption coefficient is above 0.75 for the frequency ranges of approximately 400 Hz to 600 Hz and 1450 Hz to 1650 Hz. However, the absorption coefficient falls below 0.6 between approximately 1000 Hz and 1200 Hz, dropping virtually to zero at its resonant frequency of approximately 1100 Hz.

Curve 72 is a predicted graph and curve 73 is an actual measurement graph of an installed light fixture with a 2 inch layer of white melamine foam lining the rear wall of the cavity. In this case the ceiling absorption coefficient is above 0.6 only when the frequency is above approximately 800 Hz.

Curve 74 shows the predicted affect on ceiling absorption coefficient when the 2 inch layer of melamine foam is combined with the micro-perforated diffuser and the 6 inch deep cavity. In this embodiment the predicted ceiling absorption coefficient remains above 0.6 for all frequencies above approximately 300 Hz.

The impedance of sound absorbing material 52, such as an acoustic foam, is a function of density, thickness, flow resistivity, porosity, tortuosity, etc. The impedance of a perforated film diffuser 44 depends on effective pore length, porosity and pore diameter; and the impedance of fiberglass can be controlled by fiber diameter, resins, fiber orientations, etc. Therefore, the optimization of the ceiling acoustical performance is a task to identify the right combination of right materials under the system requirements and constraints.

Though the sound absorbing light fixture 42 has been described in this embodiment as being installed in a ceiling system 40 of an elevator cab 32, it will be clear to one skilled in the art that the light fixture may be installed in other enclosed interiors as well. By way of example, the sound absorbing light fixture could attenuate sound energy in the room of a building or house. Moreover, though this embodiment describes the light fixture as installed in a ceiling system, it will be clear to one skilled in the art that the light fixture may be installed in other surface systems as well, e.g., interior walls of an elevator cab.

The sound absorbing light fixture 42 may additionally be used as a kit, i.e., spare part, to retrofit existing prior art interiors such as an elevator cab.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A sound absorbing light fixture for use in a surface system of an enclosed interior, the light fixture comprising:

a frame disposed in fixed relationship to the surface system, the frame having an interior rear surface and interior side surfaces extending outwardly from the rear surface to define a cavity;

a light source disposed within the cavity; and a light diffuser disposed in fixed relationship to a front portion of the frame between the light source and the enclosed interior, wherein the installed light fixture enhances a sound absorption coefficient of the surface system for a predetermined frequency range of sound energy; and wherein the diffuser further comprises a material having an impedance substantially matched to a predetermined range of air impedance for the predetermined frequency range.

2. The sound absorbing light fixture of claim 1 wherein the diffuser further comprises a porous material having a predetermined flow resistivity range for the predetermined frequency range.

3. The sound absorbing light fixture of claim 1 wherein the enclosed interior is in the interior of an elevator cab.

4. A sound absorbing light fixture for use in a surface system of an enclosed interior, the light fixture comprising:

a frame disposed in fixed relationship to the surface system, the frame having an interior rear surface and interior side surfaces extending outwardly from the rear surface to define a cavity;

a light source disposed within the cavity; and a light diffuser disposed in fixed relationship to a front portion of the frame between the light source and the enclosed interior, wherein the installed light fixture enhances a sound absorption coefficient of the surface system for a predetermined frequency range of sound energy; and wherein the cavity is sized to attenuate sound energy within the predetermined frequency range.

5. The sound absorbing light fixture of claim 4 wherein the depth of the cavity is sized to substantially equal a predetermined percentage of wavelength of a predetermined frequency of sound.

6. The sound absorbing light fixture claim 4 wherein the depth of the cavity is sized to substantially equal 25 percent of a wavelength of a predetermined frequency of sound.

7. The sound absorbing light fixture of claim 4 wherein the predetermined frequency range is from 100 to 2000 Hz.

8. A sound absorbing light fixture for use in a surface system of an enclosed interior, the light fixture comprising:

a frame disposed in fixed relationship to the surface system, the frame having an interior rear surface and interior side surfaces extending outwardly from the rear surface to define a cavity;

a light source disposed within the cavity; and a light diffuser disposed in fixed relationship to a front portion of the frame between the light source and the enclosed interior, wherein the installed light fixture enhances a sound absorption coefficient of the surface system for a predetermined frequency range of sound energy; and wherein the interior rear surface of the frame is lined with a sound absorbing material.

9. The sound absorbing light fixture of claim 8 wherein the sound absorbing material comprises an acoustic foam.

10. The sound absorbing light fixture of claim 9 wherein the acoustic foam further comprises melamine foam.

11. A sound absorbing light fixture for use in a surface system of an enclosed interior, the light fixture comprising:

a frame disposed in fixed relationship to the surface system, the frame having an interior rear surface and interior side surfaces extending outwardly from the rear surface to define a cavity;

a light source disposed within the cavity; and a light diffuser disposed in fixed relationship to a front portion of the frame between the light source and the enclosed interior, wherein the installed light fixture enhances a sound absorption coefficient of the surface system for a predetermined frequency ranged sound energy; and wherein the sound absorption coefficient exceeds 0.6.

12. The sound absorbing light fixture of claim 11 wherein the frequency range is 300 Hz to 600 Hz.

13. The sound absorbing light fixture of claim 11 wherein the frequency range is 400 Hz to 600 Hz and 1450 to 1650 Hz.

14. The sound absorbing light fixture of claim 11 wherein the frequency range is 400 Hz to 2000 Hz.

15. The sound absorbing light fixture of claim 11 wherein the frequency range is 1000 Hz to 2000 Hz.

16. An elevator system comprising:

an elevator cab defining an enclosed interior for carrying passengers;

an elevator ceiling system disposed in a top portion of the enclosed interior; and a sound absorbing light fixture installed in the elevator ceiling system, the light fixture including, a frame disposed in fixed relationship to the elevator ceiling system, the frame having an interior rear surface and interior side surfaces extending outwardly from the rear surface to define a cavity, a light source supported by the frame within the cavity; and a light diffuser disposed in fixed relationship to a front portion of the frame between the light source and the enclosed interior, wherein the installed light fixture enhances a sound absorption coefficient of the elevator ceiling system for a predetermined frequency range of sound energy.

17. The elevator system of claim 16 wherein the diffuser further comprises a material having an impedance substantially matched to a predetermined percentage range of air impedance for the predetermined frequency range.

18. The elevator system of claim 16 wherein the cavity is sized to attenuate sound energy within the predetermined frequency range.

19. The elevator system of claim 16 wherein the interior rear surface of the frame is lined with a sound absorbing material.

20. The sound absorbing light fixture of claim 16 wherein the sound absorption coefficient exceeds 0.6 for the frequency ranges of 300 Hz to 600 Hz.

21. The sound absorbing light fixture of claim 16 wherein the sound absorption coefficient exceeds 0.75 for the frequency ranges of 400 Hz to 600 Hz and 1450 to 1650 Hz.

22. The elevator system of claim 16 wherein the diffuser further comprises a porous material.

23. The elevator system of claim 16 wherein the diffuser further comprises a porous material having a predetermined flow resistivity range for the predetermined frequency range.

* * * * *